US007516585B2

(12) United States Patent
Lehane, Jr. et al.

(10) Patent No.: US 7,516,585 B2
(45) Date of Patent: Apr. 14, 2009

(54) GRID TEE FOR SUSPENSION CEILING

(75) Inventors: James J. Lehane, Jr., McHenry, IL (US); Peder J. Gulbrandsen, Aurora, IL (US); Martin E. Likozar, Richmond Heights, OH (US)

(73) Assignee: USG Interiors, Inc., Chicago, IL (US)

( * ) Notice: Subject to any disclaimer, the term of this patent is extended or adjusted under 35 U.S.C. 154(b) by 212 days.

(21) Appl. No.: 11/283,619

(22) Filed: Nov. 21, 2005

(65) Prior Publication Data

US 2007/0125038 A1 Jun. 7, 2007

(51) Int. Cl.
*E04B 9/06* (2006.01)

(52) U.S. Cl. ..... 52/506.07; 29/897.312

(58) Field of Classification Search ..... 52/506.07, 52/506.01, 667, 506.06, 733.1; 29/897.35, 29/897.312, 897.31, 432.2, 521; D25/131; 72/199

See application file for complete search history.

(56) References Cited

U.S. PATENT DOCUMENTS

| | | | | | |
|---|---|---|---|---|---|
| 991,603 | A | | 5/1911 | Brooks | |
| 1,833,174 | A | | 11/1931 | Norris | |
| 2,059,483 | A | * | 11/1936 | Parsons | 52/506.06 |
| 2,254,558 | A | | 9/1941 | Wiliams | |
| 2,307,653 | A | | 1/1943 | Wright | |
| 2,403,580 | A | | 7/1946 | Cartwright et al. | |
| 2,447,694 | A | | 8/1948 | Finch | |
| 2,457,148 | A | | 12/1948 | Hall et al. | |
| 2,920,357 | A | | 1/1960 | Ericson | |
| 3,059,735 | A | | 10/1962 | Sowinski | |
| 3,202,077 | A | * | 8/1965 | Lee | 454/301 |
| 3,325,954 | A | | 6/1967 | Olson | |
| 3,342,007 | A | | 9/1967 | Merson | |
| 3,354,598 | A | | 11/1967 | Nicholson | |
| 3,355,206 | A | * | 11/1967 | Valsvik | 403/264 |
| 3,369,332 | A | | 2/1968 | Harlan | |
| 3,370,301 | A | | 2/1968 | Harlan | |
| 3,511,012 | A | | 5/1970 | Brady | |
| 3,599,921 | A | | 8/1971 | Cumber | |
| 3,612,461 | A | | 10/1971 | Brown | |
| 3,832,816 | A | | 9/1974 | Jahn | |
| 3,848,385 | A | | 11/1974 | Thompson | |
| 3,881,286 | A | | 5/1975 | Smith et al. | |
| 3,996,716 | A | | 12/1976 | Tuten et al. | |

(Continued)

FOREIGN PATENT DOCUMENTS

| | | |
|---|---|---|
| DE | 35 25 139 A1 | 1/1987 |

(Continued)

*Primary Examiner*—Richard E Chilcot, Jr.
*Assistant Examiner*—Bryan Eppes
(74) *Attorney, Agent, or Firm*—Pearne & Gordon LLP

(57) ABSTRACT

In one embodiment, a roll formed sheet metal tee for grid type suspended ceilings with the face of its flange integral with the stem and the layers of the stem fixed together for improved torsional strength. An upper region of the stem can have one or more of its layers folded to increase suspension wire breakout strength. A stiffening bulb is below suspension wire receiving holes so that a loop of the suspension wire through the tee has a narrow profile and thereby avoids interference with ceiling panels during their installation or removal. Other embodiments of a tee share the feature of a narrow, suspension wire receiving upper stem portion.

2 Claims, 4 Drawing Sheets

U.S. PATENT DOCUMENTS

| | | | | | |
|---|---|---|---|---|---|
| 4,144,691 | A | | 3/1979 | Hindman | |
| 4,206,578 | A | | 6/1980 | Mieyal | |
| RE31,528 | E | | 3/1984 | Mieyal | |
| 4,489,529 | A | | 12/1984 | Ollinger et al. | |
| 4,520,609 | A | | 6/1985 | Worley et al. | |
| 4,525,973 | A | | 7/1985 | Vukmanic et al. | |
| 4,542,615 | A | | 9/1985 | McCall | |
| 4,549,383 | A | | 10/1985 | Vukmanic et al. | |
| 4,601,153 | A | | 7/1986 | Dunn et al. | |
| 4,677,802 | A | | 7/1987 | Vukmanic | |
| 4,783,946 | A | * | 11/1988 | Boegle | 52/733.1 |
| 4,785,595 | A | | 11/1988 | Dunn | |
| 4,794,745 | A | * | 1/1989 | Platt et al. | 52/506.07 |
| 4,817,357 | A | | 4/1989 | Hocevar | |
| 4,850,172 | A | | 7/1989 | Gailey et al. | |
| 4,852,325 | A | | 8/1989 | Dunn et al. | |
| 4,932,186 | A | * | 6/1990 | Jahn | 52/733.1 |
| 4,989,387 | A | | 2/1991 | Vukmanic et al. | |
| 5,044,138 | A | | 9/1991 | Zaccardelli et al. | |
| 5,577,313 | A | | 11/1996 | Guido et al. | |
| 5,732,521 | A | | 3/1998 | Schmitt-Raiser | |
| 5,860,265 | A | * | 1/1999 | Knudson et al. | 52/731.9 |
| 5,893,249 | A | | 4/1999 | Peterson et al. | |
| 5,896,724 | A | | 4/1999 | Tofts | |
| 5,979,055 | A | | 11/1999 | Sauer et al. | |
| 6,041,564 | A | | 3/2000 | Shirey | |
| 6,047,511 | A | | 4/2000 | Lehane et al. | |
| 6,050,534 | A | | 4/2000 | Andrews | |
| 6,138,416 | A | | 10/2000 | Platt | |
| 6,446,407 | B1 | | 9/2002 | Lehane et al. | |
| 6,701,686 | B1 | | 3/2004 | Platt | |
| 6,722,098 | B2 | | 4/2004 | Platt | |
| 2007/0028554 | A1 | | 2/2007 | Ferrell et al. | |
| 2007/0113507 | A1 | * | 5/2007 | Lehane, Jr. | 52/506.07 |
| 2007/0175152 | A1 | * | 8/2007 | Kupec et al. | 52/506.07 |
| 2007/0277466 | A1 | | 12/2007 | Platt | |
| 2007/0277467 | A1 | | 12/2007 | Platt | |
| 2007/0277468 | A1 | | 12/2007 | Platt | |
| 2008/0148668 | A1 | * | 6/2008 | Jahn et al. | 52/506.07 |

FOREIGN PATENT DOCUMENTS

| | | | | |
|---|---|---|---|---|
| DE | 4124553 | A1 | * | 3/1992 |
| EP | 0 037 061 | B1 | | 10/1981 |

* cited by examiner

GRID TEE FOR SUSPENSION CEILING

BACKGROUND OF THE INVENTION

The invention relates to suspended ceiling systems and, in particular, to an improved grid tee.

PRIOR ART

Suspended ceilings, extensively used in commercial buildings, typically employ a rectangular grid system that supports lay-in ceiling panels or tiles. The grid is made up of regularly spaced runners intersecting at right angles. The runners are ordinarily in the form of inverted tees. The tees are normally suspended by wires and the ceiling panels or tiles rest on the flanges of the tees.

The suspended ceiling products industry has refined the design and manufacture of grid tees to a high degree. The continuous efforts for improvement have contributed to the high acceptance of these ceiling systems in the construction industry. Challenges have remained in creating improvements in the performance and in reducing the cost of the grid systems.

SUMMARY OF THE INVENTION

The invention provides an improved grid tee for suspended ceilings that, compared to prior art constructions can facilitate installation of lay-in tiles, can be produced with less material cost and can obtain greater strength and rigidity. The invention, in one design, utilizes a single strip of sheet metal folded on itself in such a manner that the bending and torsional stiffness as well as suspension wire breakout can be increased even while metal content can be decreased. The folded cross-section of the single strip design advantageously employs the visible face of the tee as a primary structural element so that the face serves to increase rigidity. Employing the face material as a structural element is particularly advantageous because the face material is at a location where it can be of maximum benefit as it contributes to the polar moment of inertia. The longitudinal edges of the strip are folded into mutual contact and are locked together both laterally and longitudinally, thereby significantly increasing the torsional stiffness of the tee.

Multiple layers of sheet material at the top of the inverted tee section permit suspension wires to be threaded through this area without the risk of low breakout strength. The multiple layer top edge surmounts a laterally extending reinforcing bulb. This geometry avoids the necessity of wrapping the bulb itself with a loop of suspension wire. As a result, the suspension wire loop can be smaller than the width of the bulb. Consequently, the ceiling tiles can be easily and quickly installed or removed without damage or difficulty from interference with what otherwise would be an oversize wire loop of suspension wire. As disclosed, the inventive feature of a narrow top wire receiving stem portion can be applied to other tee constructions.

DESCRIPTION OF THE PREFERRED EMBODIMENTS

Figure 1:
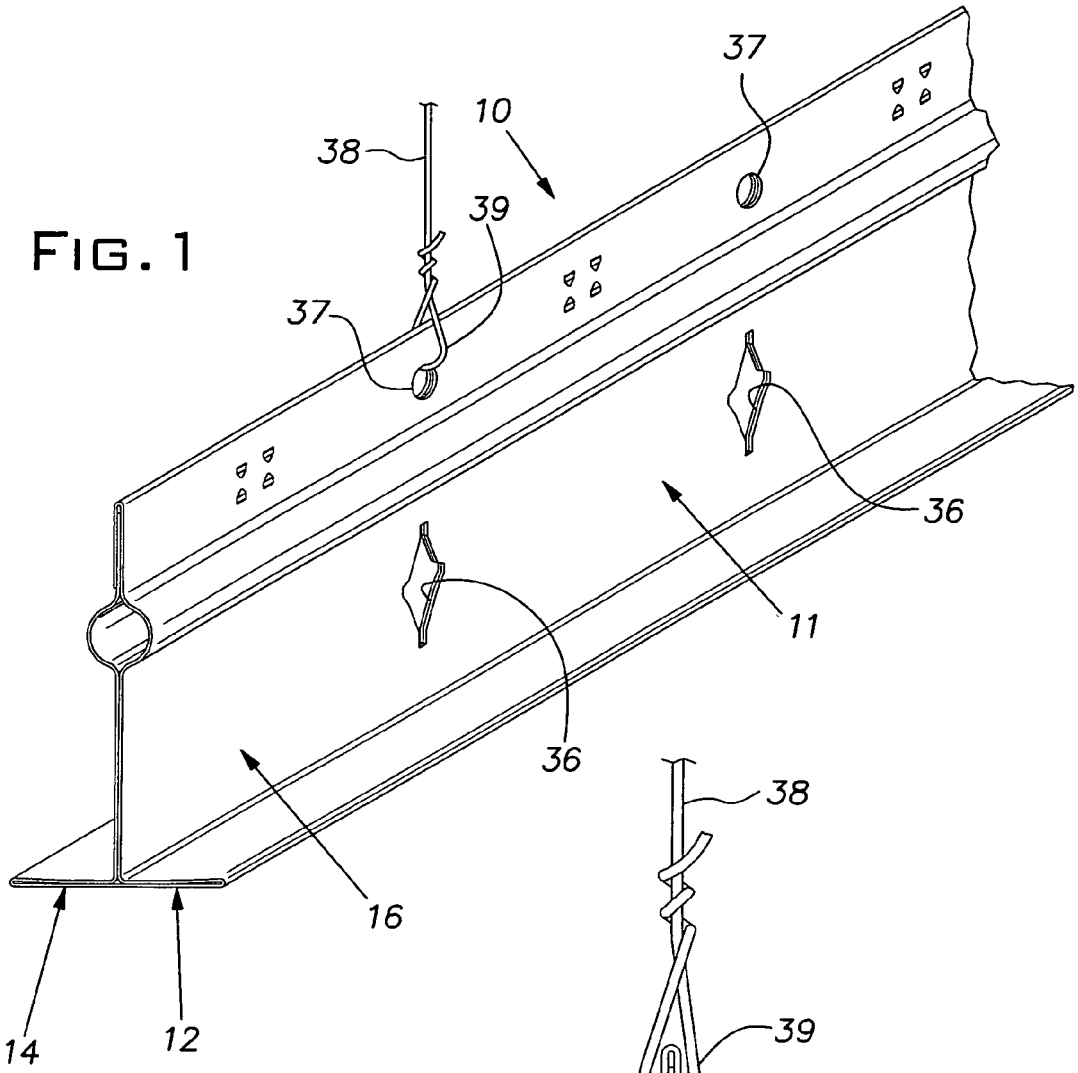
FIG. 1 is a perspective view of a grid tee constructed in accordance with the invention.
Figure 2:
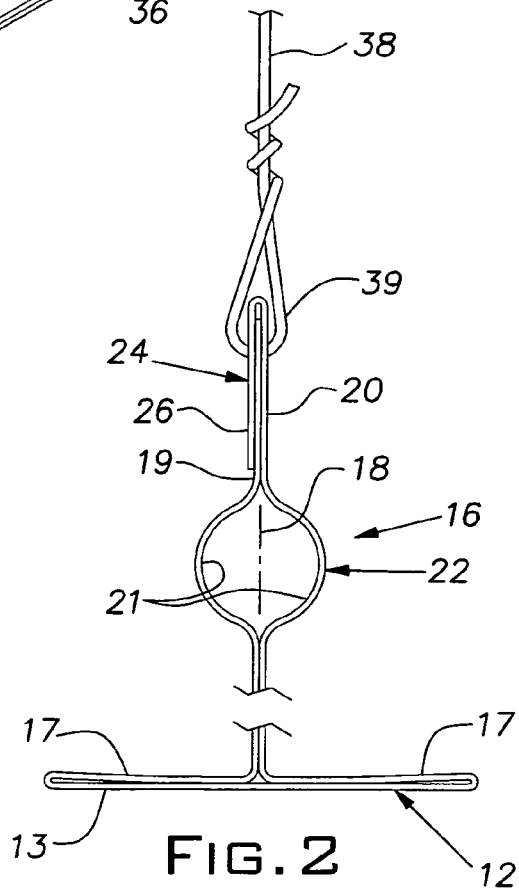
FIG. 2 is a cross-sectional view of the grid tee on an enlarged scale.

A grid tee 10 is preferably formed of a sheet metal strip which can be galvanized or otherwise treated to resist corrosion. The tee 10 is made, preferably by roll-forming techniques known to those skilled in the art, into the cross section illustrated, for example, in FIG. 2. A center section 12 of the strip 11 is preferably painted before the strip is formed into the tee cross-section. The painted center section 12 forms a visible face 13. The sheet metal strip 11 is folded back on itself at opposed edges of the face 13 to form a double layer flange 14 extending laterally on opposite sides of a central web or stem 16. Inner layers 17 of the flange 14 extend from the laterally outward extremities of the flange to a central imaginary plane 18 and preferably abut the outer layer or center section 12 substantially along their full widths. The inner layers 17 of the flange 14 intersect at the imaginary plane 18 where the sheet metal strip is bent at right angles to form the web 16 as double layers 19, 20. At a distance above the flange 14, preferably greater than about half the total height of the web 16, the web layers 19, 20 are each formed with a channel 21 open on an inside face. The channels 21, ideally, are mirror images of one another symmetrically disposed about the central imaginary plane 18 and cooperating to form a hollow reinforcing bulb 22. The illustrated bulb 22 is generally circular in cross-section but can have other shapes such as rectangular.

Figure 3:
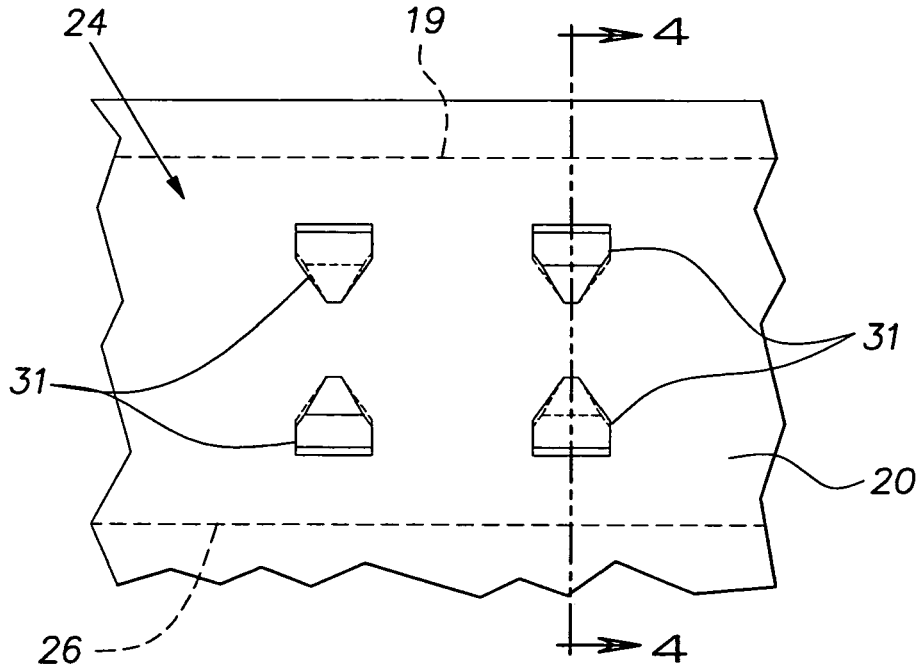
FIG. 3 is an enlarged elevational view of a part of an upper portion of the grid tee.
Figure 4:
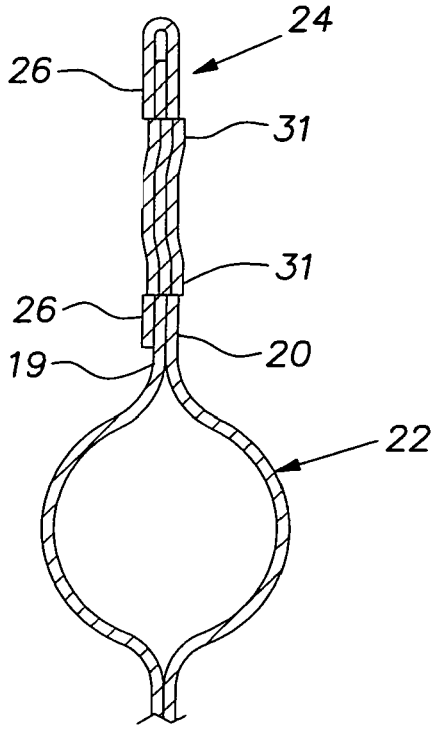
FIG. 4 is a cross-sectional view of the upper portion of the grid tee taken on the plane 4-4 indicated in FIG. 3 showing one manner of locking the grid tee layers together.

At an upper portion 24 of the web 16 above the bulb 22, the two web layers 19, 20 abut at or adjacent the imaginary central plane 18 for a vertical distance that, in the illustrated case, is the about the same as the vertical extent of the bulb 22. The layer 20 of one side of the web 16 is somewhat wider than the other side enabling an excess width part 26 to be folded over the other layer 19. As a result, the upper edge of the web 16 comprises three layers of sheet stock. The layers 19, 20 and 26 at this upper edge portion 24 of the web 16 are fixed relative to each other by lanced tabs 31 cut through the material of these layers with suitable punches. Each lanced tab 31 can be distorted to foreshorten it and then be set back partially into the plane of the web 16 but out of registration with its original layer so that it is locked against the edge of an adjacent layer thus locking such adjacent layers from moving in the longitudinal direction of the tee relative to each other as well as in any other direction relative to one another. In the illustrated example, the lanced tabs 31 are in groups of four, a pair on the right is displaced above the plane of the drawing of FIG. 3 as shown in FIG. 4. The pair at the left are similarly spaced below the plane of the drawing.

The lower part of the web 16 is formed with longitudinally spaced slots 36 aligned through both layers 19, 20 for receiving end connectors of cross tees as is conventional. Holes or apertures 37 are punched or otherwise formed in the upper part 24 of the web 16 spaced along the length of the tee 10. These holes 37 are provided for suspending the tee 10 and ultimately the ceiling tiles supported on the tees, with wires such as that shown in FIG. 2. The disclosed arrangement wherein the suspension wires 38 are assembled through flat, vertical abutting layers 19, 20, 26 of the web 16 above the reinforcing or stiffening bulb 22, permits the profile or spread of a wire loop 39 around the upper web portion 24 to be relatively narrow and have less width in a plane transverse to the longitudinal direction of the tee than the width of the bulb 22. This is a significant advantage when installing and removing ceiling tiles since interference between the wire loops 39 and tile is effectively eliminated and, the risk of damage to the tile is effectively avoided. This feature can reduce overall installation time and cost of a ceiling system.

Figure 5:
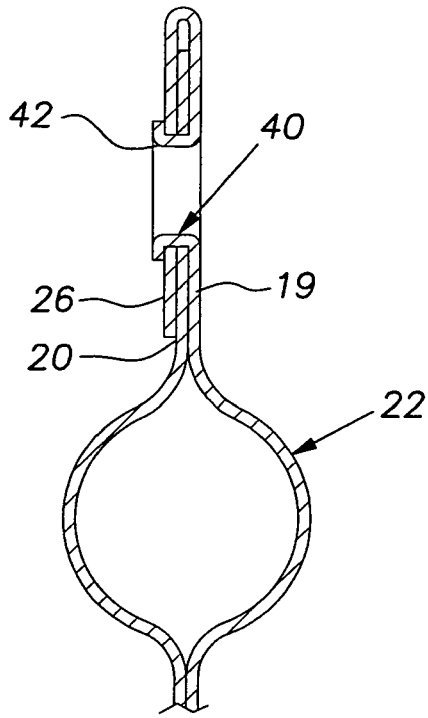
FIG. 5 is a view similar to FIG. 4 with another example of a manner of locking the layers of the grid tee upper portion together.

Various methods, besides the lanced tabs 31, can be used to lock the sheet metal layers 19, 20 and 26 at the upper region 24 of the web 16 together so that there is no longitudinal slippage of these layers relative to one another. FIG. 5 illustrates one alternative for locking these layers 19, 20 and 26 together and is disclosed in greater detail in U.S. Pat. No. 6,041,564. A hole 40 is pierced through these layers 19, 20 and 26, and the material of one layer 19 is formed into an integral rivet or eyelet 42. The hole 40 can be used for suspending the grid tee by threading the suspension wire 38 through it. U.S. Pat. Nos. 5,979,055 and 6,047,511, for example, show other methods of locking the stem layers together with material integral with the stem. Alternatively, the layers 19, 20 and 26 of the upper region or portion 24 can be fixed against relative movement by other methods such as with separate fasteners, welding, and/or adhesives, for example. With the layers of the stem or web 16 fixed together, the torsional stiffness of the tee or grid member is increased from what would occur where the layers were free to slide relative to one another.

Figure 6:
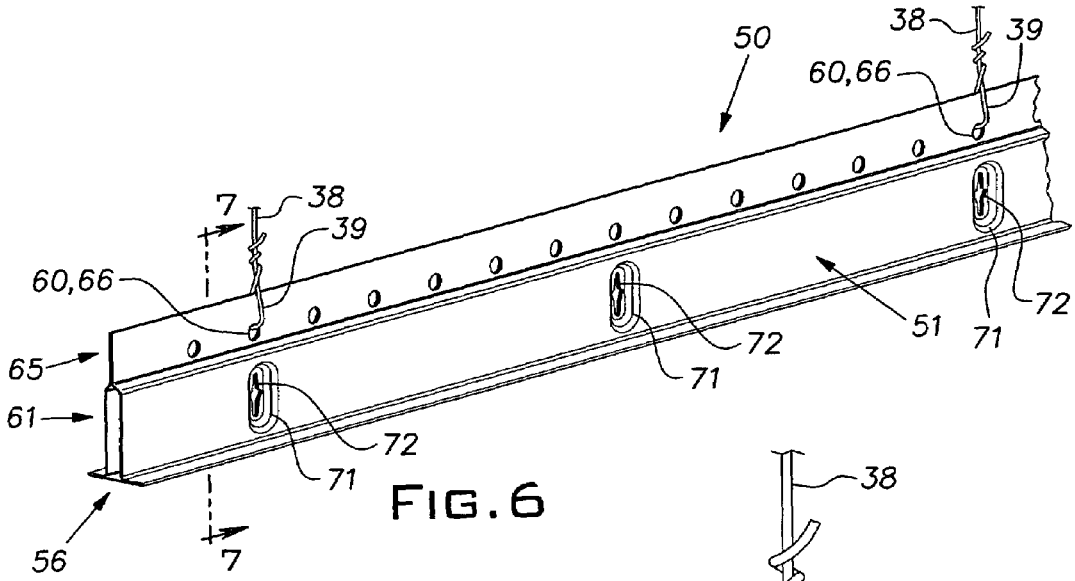
FIG. 6 is a perspective view of a section of a grid tee in accordance with another embodiment of the invention.
Figure 7:
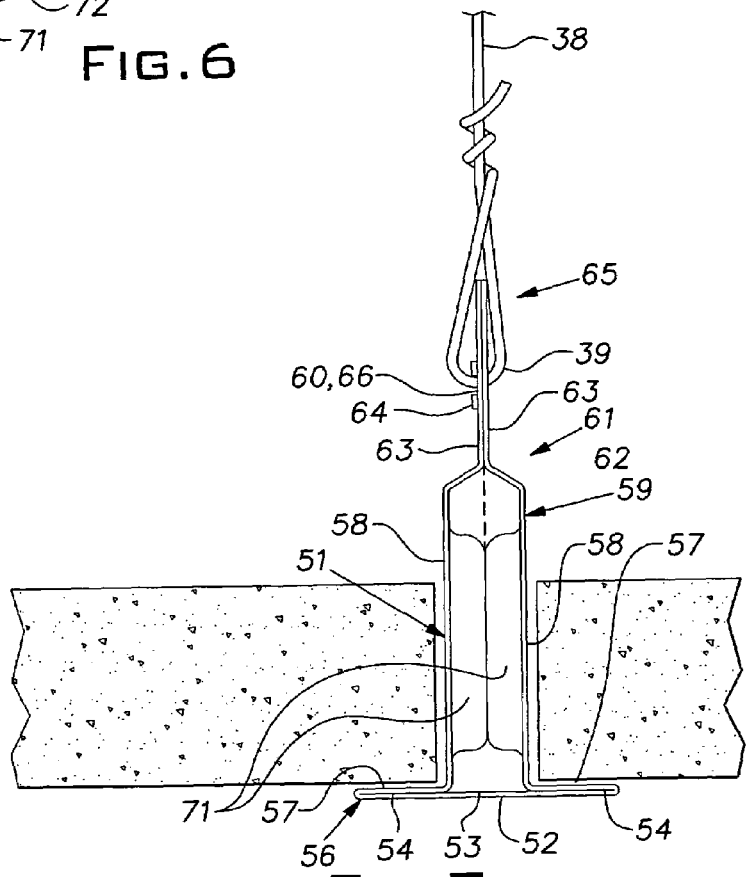
FIG. 7 is a cross-sectional view of the grid tee taken in the plane 7-7 indicated in FIG. 6.

FIGS. 6 and 7 illustrate a second embodiment of a grid tee 50, constructed in accordance with the invention. The tee is formed of a single metal strip 51 preferably with its center region painted on one side to finish a face 52 of an exposed layer 53. The strip is ideally galvanized or otherwise finished prior to finish painting to avoid corrosion. The strip 51 is preferably shaped by roll-forming techniques, and is folded back on itself to form opposite sections 54 of a lower flange 56. Inner flange layers 57 ideally abut the face layer 53 along substantially their full width, which is short of half the width of the face layer. At interior edges of the inner flange layers 57, the tee sheet material is bent up vertically to form respective sides 58 of a hollow bulb 59 forming a lower section of a web or stem 61. At the top of the bulb 59, layers of the sheet or strip 51 are turned towards a central imaginary plane 62 and at the central plane are then folded or bent upwardly so that sections 63 of the metal strip 51 form an upper region 65 of the web 61. The web upper region layers 63 are fixed together by integral rivets or grommets 60 each formed from the material of one layer 63 displaced through a hole in the other layer and then upset or clinched to form a flange 64 on the outer side of the other layer. The upper region 65 of the web 61 can be constructed like the analogous region 24 of the tee 10 shown in FIG. 2, if desired, thereby comprising three layers in this web region. A suspension wire 38 can be passed through a selected hole or aperture 66 of a rivet 60 and looped around a portion of the upper web section as shown in FIGS. 6 and 7. As with the grid tee 10, the upper portion 65 of the web 61 can have its layers locked together with other alternative or supplemental techniques such as staking, use of separate fasteners, welding and/or adhesives, for example. Along the length of the tee 50 at regularly spaced centers, such as every six inches the sides 58 of the hollow bulb 59 are locally deformed with oval or oblong depressions 71 of sufficient depth to cause the sheet material of each of the sides 58 to abut. The depressions 71 are of sufficient height to allow a vertical slot 72 to be formed in each of the layers of the sides 58 for the reception of end connectors of cross tees. The height and width of the depressions 71 is sufficient to receive an end connector and allow it to pass through the respective slot 72. Less than all of the holes formed in the upper region of the web can be clinched in the manner of a grommet.

The ends of the tees 10 and 50 can be provided with standard connectors; typically the ends of the tee 50 are flattened by pressing the walls or sides 58 together to accommodate a standard connector.

Figure 8:
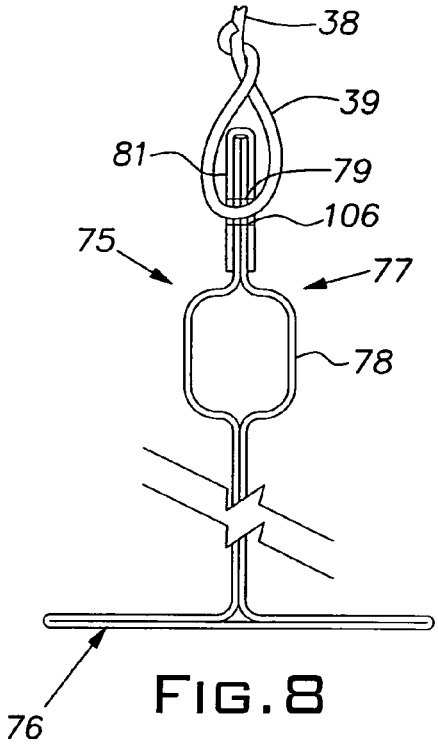
FIG. 8 is a cross-sectional view of a modified grid tee.

FIGS. 8-11 illustrate additional alternative embodiments of tee constructions. In FIG. 8, a sheet metal tee 75 formed in the manner described above has a flange 76 and a stem 77 including a hollow bulb portion 78 and an upper portion 79 formed of a single strip of metal stock. The strip is doubled on itself, as described above, in the flange and stem areas apart from the hollow bulb 78. The upper stem area or portion 79 is sandwiched by a separately formed inverted U-shape metal channel 81. The channel 81 can be roll formed from a sheet metal strip. The layers of the upper stem portion 79 and channel 81 are fixed together by any of the methods of the previously described tees.

Figure 9:
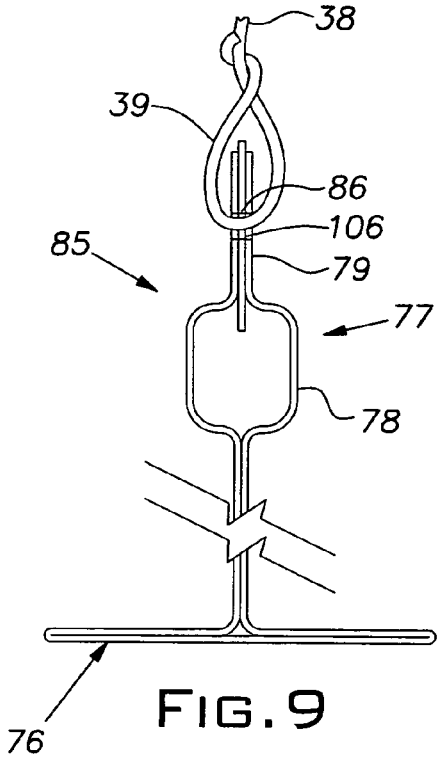
FIG. 9 is a cross-sectional view of another modified grid tee.

A tee 85 depicted in FIG. 9 is similar in construction to the tee 75 of FIG. 8 and has certain parts designated with the same numerals. The upper stem portion 79 has its layers reinforced by an intermediate strip 86 preferably of a suitable metal such as steel. As before, the abutting layers of the upper portion of the stem 79 and strip 86 are locked together by one of the techniques described above.

Figure 10:
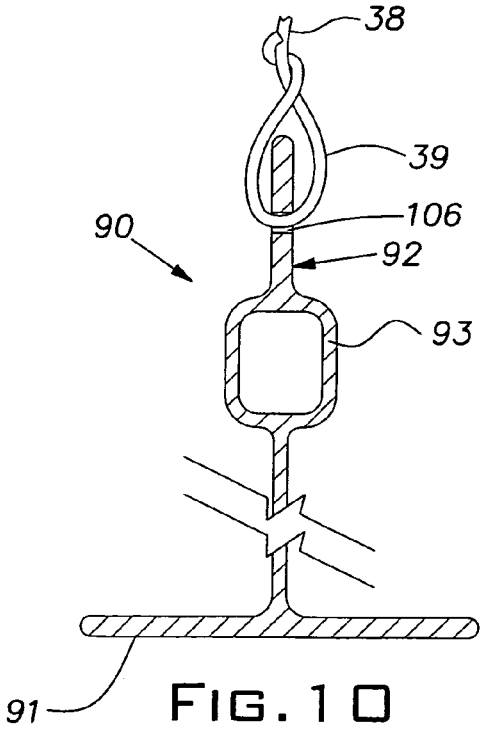
FIG. 10 is a cross-sectional view of a further modified grid tee.

FIG. 10 illustrates an extruded tee 90 having a flange 91 and stem 92. The stem 91 includes a hollow bulb 93. The tee 90 can be formed of aluminum or other suitable metal or plastic.

Figure 11:
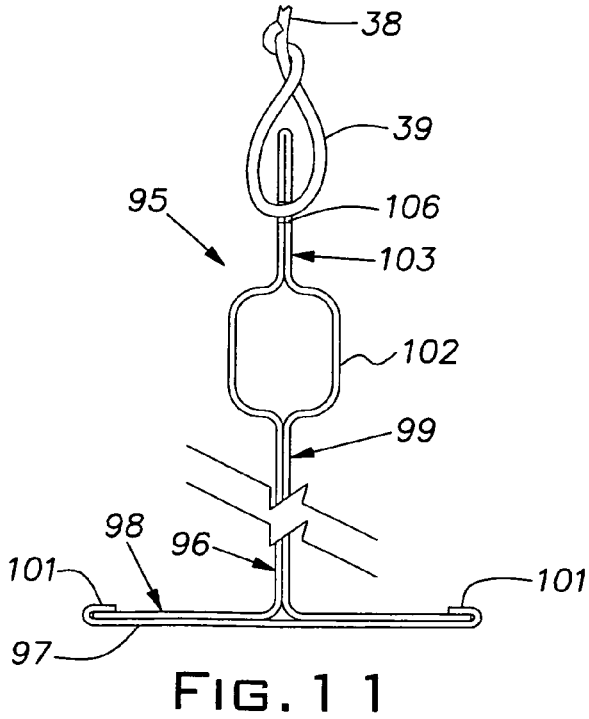
FIG. 11 is a cross-sectional view of still another modified grid tee.

FIG. 11 illustrates still another tee 95 formed, like earlier described tees of strips of roll formed metal sheet stock. The tee 95 comprises a main body strip 96 and a cap strip 97. The main body strip 96 forms an upper or inner layer of a flange 98 and a stem 99. The cap strip 97 forms the cover or outer face layer of the flange 98 and includes opposed in-turned hems 101 that lock the cap strip 97 on the main strip 96 and the adjacent areas of the stem 99 together. The stem 99 includes a hollow bulb 102 and an upper portion 103.

In each of the arrangements of FIGS. 8-11, holes 106 can be spaced along the length of the tee in the upper stem portion and any associated structure. Suspension wires 38 can be looped through such holes 106 in the upper portion of the tee stem or web above a hollow bulb. This feature, as in the arrangements of FIGS. 1-7, permits the wire loop 39 to be at least as small in width as the width of the respective bulb thereby avoiding interference with installation or removal of a ceiling tile.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. For example, the upper edge region of the web can be formed with more than three layers of sheet metal by making additional folds. Accordingly, the patent is not to be limited in scope and effect to the specific embodiments herein shown and described nor in any other way that is inconsistent with the extent to which the progress in the art has been advanced by the invention.

What is claimed is:

1. A roll-formed grid member for a suspended ceiling made from a single metal strip, the member being generally symmetrical about an imaginary central vertical plane and having a cross-section that includes a lower horizontal flange extending laterally on both sides of the central plane, the flange being formed of a double layer of said metal strip folded back on itself at each of its lateral extremities, a generally vertical stem formed of two layers of said metal strip, one stem forming layer on each side of said imaginary plane, said stem forming layers being fixed together to prevent relative longitudinal sliding movement therebetween and thereby increasing the torsional stiffness of the grid member from what would occur where said layers are free to slide relative to one another, said stem forming layers being in abutting contact in a zone, said contact zone being above any zone where said stem forming layers are substantially laterally separated, said stem forming layers being separated in a zone extending vertically from said flange to said contact zone to form a reinforcing bulb, said stem forming layers forming said reinforcing bulb being formed with laterally inward depressions in abutting contact with one another at regularly spaced locations, and said layers have aligned slots at said depressions to receive connectors of cross tees.

2. A roll-formed grid member for a suspended ceiling made from metal strip, the member being generally symmetrical about an imaginary vertical plane and having a cross-section that includes a lower horizontal flange extending laterally on both sides of the imaginary plane, the flange being formed of said metal strip, a generally vertical stem formed of two layers of said metal strip, one stem forming layer on each side of said imaginary plane, said stem forming layers being separated above said flange to form a reinforcing bulb, said stem forming layers being in abutting contact in a zone above said reinforcing bulb, and aligned longitudinally spaced apertures in said layers in said contact zone for receiving loops of suspension wires, said contact zone above said apertures being free of overlying structure of said grid member which would otherwise require the loops of suspension wires to be wider than that required by said contact zone, said stem forming layers forming said reinforcing bulb having depressions at longitudinally spaced locations, said stem forming layers being in abutting contact and being formed with aligned slots for reception of connectors of cross tees at said depressions.

* * * * *